US008703663B2

(12) United States Patent
Tagawa

(10) Patent No.: US 8,703,663 B2
(45) Date of Patent: Apr. 22, 2014

(54) LUBRICANT BASE OIL AND A PROCESS FOR PRODUCING THE SAME, AND LUBRICATING OIL COMPOSITION

(75) Inventor: Kazuo Tagawa, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 85 days.

(21) Appl. No.: 13/122,622

(22) PCT Filed: Oct. 1, 2009

(86) PCT No.: PCT/JP2009/067163

§ 371 (c)(1),
(2), (4) Date: Jun. 10, 2011

(87) PCT Pub. No.: WO2010/041591

PCT Pub. Date: Apr. 15, 2010

(65) Prior Publication Data

US 2011/0230685 A1 Sep. 22, 2011

(30) Foreign Application Priority Data

Oct. 7, 2008 (JP) ..... P2008-261070

(51) Int. Cl.
*C10M 169/04* (2006.01)
*C10G 71/00* (2006.01)

(52) U.S. Cl.
USPC ..... 508/110; 208/19

(58) Field of Classification Search
USPC ..... 508/110, 469; 208/19
See application file for complete search history.

(56) References Cited

U.S. PATENT DOCUMENTS

| | | | |
|---|---|---|---|
| 2,861,941 | A | 11/1958 | Jancosek et al. |
| 2,890,161 | A | 6/1959 | Brown et al. |
| 3,078,222 | A | 2/1963 | Henke et al. |
| 3,847,790 | A | 11/1974 | Putz |
| 4,021,357 | A | 5/1977 | Morduchowitz et al. |
| 4,867,894 | A | 9/1989 | Pennewiss et al. |
| 5,282,958 | A | 2/1994 | Santilli et al. |
| 5,362,378 | A | 11/1994 | Borghard et al. |
| 5,652,201 | A | 7/1997 | Papay et al. |
| 5,763,374 | A | 6/1998 | Sakai et al. |
| 5,955,405 | A | 9/1999 | Liesen et al. |
| 6,077,455 | A | 6/2000 | Bloch et al. |
| 6,090,989 | A | 7/2000 | Trewella et al. |
| 6,383,366 | B1 | 5/2002 | Riley et al. |
| 6,602,402 | B1 | 8/2003 | Benazzi et al. |
| 7,285,206 | B2 | 10/2007 | Germaine |
| 7,867,957 | B2 | 1/2011 | Matsui et al. |
| 2001/0056044 | A1 | 12/2001 | Kinker et al. |
| 2002/0119896 | A1 | 8/2002 | Yagishita et al. |
| 2003/0036488 | A1 | 2/2003 | Yuki et al. |
| 2003/0104955 | A1 | 6/2003 | Yuki et al. |
| 2003/0162673 | A1 | 8/2003 | Kurihara et al. |
| 2003/0226785 | A1 | 12/2003 | Murphy et al. |
| 2004/0045868 | A1 | 3/2004 | Germaine |
| 2004/0065588 | A1 | 4/2004 | Genetti et al. |
| 2004/0077509 | A1 | 4/2004 | Yuki et al. |
| 2004/0079675 | A1 | 4/2004 | Germaine et al. |
| 2004/0092409 | A1 | 5/2004 | Liesen |
| 2004/0099571 | A1 | 5/2004 | Germaine et al. |
| 2004/0108249 | A1 | 6/2004 | Cody et al. |
| 2004/0112792 | A1 | 6/2004 | Murphy et al. |
| 2004/0119046 | A1 | 6/2004 | Carey et al. |
| 2004/0129603 | A1 | 7/2004 | Fyfe et al. |
| 2004/0154957 | A1 | 8/2004 | Keeney et al. |
| 2004/0154958 | A1 | 8/2004 | Alexander et al. |
| 2004/0198616 | A1 | 10/2004 | Hirao et al. |
| 2004/0224860 | A1 | 11/2004 | Baba et al. |
| 2005/0077209 | A1 | 4/2005 | Miller et al. |
| 2005/0221998 | A1 | 10/2005 | Marumo et al. |
| 2006/0027486 | A1 | 2/2006 | Rosenbaum et al. |
| 2006/0052252 | A1 | 3/2006 | Wedlock |
| 2006/0172900 | A1 | 8/2006 | Yagishita et al. |
| 2006/0205610 | A1 | 9/2006 | Rosenbaum et al. |
| 2007/0032392 | A1 | 2/2007 | Yokoyama et al. |
| 2007/0138032 | A1 | 6/2007 | Agarkov |
| 2007/0138052 | A1 | 6/2007 | Kobayashi et al. |
| 2007/0191239 | A1 | 8/2007 | Matsuoka et al. |
| 2007/0238627 | A1* | 10/2007 | Haire et al. ..... 508/485 |
| 2007/0287643 | A1 | 12/2007 | Matsui et al. |

(Continued)

FOREIGN PATENT DOCUMENTS

| | | |
|---|---|---|
| CA | 2 682 660 | 10/2008 |
| CN | 1279708 | 1/2001 |

(Continued)

OTHER PUBLICATIONS

Office Action issued with respect to Chinese Patent Application No. 200980149130.9, mailed Dec. 4, 2012.
Office Action issued with respect to Chinese Patent Application No. 201080024425.6, mailed Dec. 12, 2012.
Office Action issued with respect to Chinese Patent Application No. 201080024832.7, mailed Dec. 12, 2012.
Office Action issued with respect to U.S. Appl. No. 12/812,524, mailed Jan. 22, 2013.
Search Report issued with respect to European Patent Application No. 10783230.5, mailed Feb. 11, 2013.

(Continued)

*Primary Examiner* — Prem C Singh
*Assistant Examiner* — Francis C Campanell
(74) *Attorney, Agent, or Firm* — Greenblum & Bernstein, P.L.C.

(57) ABSTRACT

The hydrocarbon-based lubricating base oil of the invention has a urea adduct value of not greater than 4% by mass, a viscosity index of 100 or greater, and a cycloparaffin content of 30-60% by mass based on the total amount of the saturated components, as measured by field desorption/ionization mass spectrometry. The hydrocarbon-based lubricating base oil of the invention allows high levels of both viscosity-temperature characteristic and low-temperature viscosity characteristic to be obtained, and exhibits excellence in terms of evaporation property and energy efficiency.

5 Claims, No Drawings

(56) References Cited

U.S. PATENT DOCUMENTS

| | | | |
|---|---|---|---|
| 2008/0015400 | A1 | 1/2008 | Matsui et al. |
| 2008/0029430 | A1 | 2/2008 | Loh et al. |
| 2008/0029431 | A1 | 2/2008 | Alexander et al. |
| 2008/0110799 | A1 | 5/2008 | Matsui et al. |
| 2008/0248981 | A1 | 10/2008 | Matsui et al. |
| 2009/0005278 | A1 | 1/2009 | Takeuchi et al. |
| 2009/0075852 | A1 | 3/2009 | Yagishita et al. |
| 2009/0221461 | A1 | 9/2009 | Visger et al. |
| 2009/0312208 | A1 | 12/2009 | Ishikawa et al. |
| 2010/0016195 | A1 | 1/2010 | Shirahama et al. |
| 2010/0035777 | A1 | 2/2010 | Sano et al. |
| 2010/0041572 | A1 | 2/2010 | Sano et al. |
| 2010/0093578 | A1 | 4/2010 | Tsujimoto et al. |
| 2010/0130395 | A1 | 5/2010 | Tagawa et al. |
| 2010/0144571 | A1 | 6/2010 | Shirahama et al. |
| 2010/0190671 | A1 | 7/2010 | Stoehr et al. |
| 2011/0003725 | A1 | 1/2011 | Matsui et al. |
| 2011/0021394 | A1 | 1/2011 | Nakao et al. |
| 2011/0042267 | A1 | 2/2011 | Hayasaka |
| 2011/0049008 | A1 | 3/2011 | Tagawa et al. |
| 2011/0049009 | A1 | 3/2011 | Tagawa et al. |
| 2011/0053815 | A1 | 3/2011 | Matsui et al. |
| 2011/0065618 | A1 | 3/2011 | Tagawa |
| 2011/0124536 | A1 | 5/2011 | Matsui |
| 2011/0218131 | A1 | 9/2011 | Tsujimoto et al. |
| 2011/0230685 | A1 | 9/2011 | Tagawa |
| 2011/0237477 | A1 | 9/2011 | Tagawa et al. |
| 2011/0306530 | A1 | 12/2011 | Manabe et al. |
| 2012/0071373 | A1 | 3/2012 | Matsui et al. |
| 2012/0071374 | A1 | 3/2012 | Yaguchi et al. |
| 2012/0071375 | A1 | 3/2012 | Yaguchi et al. |
| 2012/0135900 | A1 | 5/2012 | Matsui et al. |
| 2012/0157361 | A1 | 6/2012 | Mutou et al. |

FOREIGN PATENT DOCUMENTS

| | | |
|---|---|---|
| CN | 1751115 | 3/2006 |
| CN | 1317368 C | 5/2007 |
| CN | 101065469 | 10/2007 |
| CN | 101213277 | 7/2008 |
| CN | 101426879 | 5/2009 |
| EP | 1 749 876 | 2/2007 |
| EP | 1 808 476 | 7/2007 |
| EP | 1 845 151 | 10/2007 |
| EP | 2 011 855 | 8/2008 |
| EP | 2 009 074 | 12/2008 |
| EP | 2 009 704 | 12/2008 |
| EP | 2 011 854 | 1/2009 |
| EP | 2 112 217 | 10/2009 |
| EP | 2135928 | 12/2009 |
| EP | 2 241 611 | 10/2010 |
| EP | 2264131 | 12/2010 |
| EP | 2264133 | 12/2010 |
| EP | 2 319 908 | 5/2011 |
| GB | 2407100 | 4/2005 |
| JP | S30-000624 | 2/1955 |
| JP | S31-003928 | 5/1956 |
| JP | S45-019183 | 7/1970 |
| JP | S48-025003 | 4/1973 |
| JP | 63-223094 | 9/1988 |
| JP | S63-309592 | 12/1988 |
| JP | 3-100099 | 4/1991 |
| JP | 4-030391 | 2/1992 |
| JP | 4-36391 | 2/1992 |
| JP | 4-68082 | 3/1992 |
| JP | 4-120193 | 4/1992 |
| JP | H5-508876 | 12/1993 |
| JP | 6-145258 | 5/1994 |
| JP | 6-306384 | 11/1994 |
| JP | 7-048421 | 2/1995 |
| JP | 7-062372 | 3/1995 |
| JP | 8-183988 | 7/1996 |
| JP | 8-302378 | 11/1996 |
| JP | 9-003463 | 1/1997 |
| JP | 2000-063439 | 2/2000 |
| JP | 2000-63877 | 2/2000 |
| JP | 2000-345170 | 12/2000 |
| JP | 2000-345171 | 12/2000 |
| JP | 2001-514301 | 9/2001 |
| JP | 2001-279278 | 10/2001 |
| JP | 2001-279287 | 10/2001 |
| JP | 2001-520302 | 10/2001 |
| JP | 2002-503754 | 2/2002 |
| JP | 2002-503755 | 2/2002 |
| JP | 2002-129182 | 5/2002 |
| JP | 2002-521499 | 7/2002 |
| JP | 2002-302687 | 10/2002 |
| JP | 2004-10799 | 1/2004 |
| JP | 2004-124080 | 4/2004 |
| JP | 2004-169029 | 6/2004 |
| JP | 2004-526831 | 9/2004 |
| JP | 2004-528426 | 9/2004 |
| JP | 2005-154760 | 6/2005 |
| JP | 2005-171186 | 6/2005 |
| JP | 2005-213447 | 8/2005 |
| JP | 2005-290238 | 10/2005 |
| JP | 2005-530902 | 10/2005 |
| JP | 2006-502297 | 1/2006 |
| JP | 2006-502298 | 1/2006 |
| JP | 2006-502303 | 1/2006 |
| JP | 2006-045277 | 2/2006 |
| JP | 2006-509899 | 3/2006 |
| JP | 2006-219642 | 8/2006 |
| JP | 2006-518395 | 8/2006 |
| JP | 2006-241436 | 9/2006 |
| JP | 2006-241437 | 9/2006 |
| JP | 2006-521416 | 9/2006 |
| JP | 2006-274209 | 10/2006 |
| JP | 2006-117851 | 11/2006 |
| JP | 2006-117853 | 11/2006 |
| JP | 2007-016172 | 1/2007 |
| JP | 2007-045850 | 2/2007 |
| JP | 2007-217494 | 8/2007 |
| JP | 2007-246659 | 9/2007 |
| JP | 2007-246661 | 9/2007 |
| JP | 2007-246662 | 9/2007 |
| JP | 2007-262239 | 10/2007 |
| JP | 2007-269885 | 10/2007 |
| JP | 2007-270059 | 10/2007 |
| JP | 2007-270062 | 10/2007 |
| JP | 2007-284635 | 11/2007 |
| JP | 2007-297528 | 11/2007 |
| JP | 2007-326963 | 12/2007 |
| JP | 2008-013281 | 1/2008 |
| JP | 2008-13681 | 1/2008 |
| JP | 2008-013684 | 1/2008 |
| JP | 2008-509244 | 3/2008 |
| JP | 2008-120908 | 5/2008 |
| JP | 2008-120909 | 5/2008 |
| JP | 2008-184569 | 8/2008 |
| JP | 2008-231189 | 10/2008 |
| JP | 2008-231190 | 10/2008 |
| JP | 2008-231191 | 10/2008 |
| JP | 2008-274236 | 11/2008 |
| JP | 2008-274237 | 11/2008 |
| JP | 2008-274238 | 11/2008 |
| JP | 2008-303344 | 12/2008 |
| JP | 2009-096925 | 5/2009 |
| JP | 2009-167278 | 7/2009 |
| JP | 2009-074068 | 9/2009 |
| JP | 2010-532805 | 10/2010 |
| WO | 9603359 | 2/1996 |
| WO | 99/41334 | 8/1999 |
| WO | 02/070629 | 9/2002 |
| WO | 2005/037967 | 4/2005 |
| WO | 2005/090528 | 9/2005 |
| WO | 2006/043709 | 4/2006 |
| WO | 2007/001000 | 1/2007 |
| WO | 2007/105769 | 9/2007 |
| WO | 2007/114132 | 10/2007 |
| WO | 2007/114260 | 10/2007 |
| WO | 2007/116759 | 10/2007 |
| WO | 2007/119299 | 10/2007 |

(56) References Cited

FOREIGN PATENT DOCUMENTS

| | | |
|---|---|---|
| WO | 2007/123266 | 11/2007 |
| WO | 2007/133999 | 11/2007 |
| WO | 2008/072526 | 6/2008 |
| WO | 2008/093446 | 8/2008 |
| WO | 2008/123246 | 10/2008 |
| WO | 2008/123249 | 10/2008 |
| WO | 2009/007147 | 1/2009 |
| WO | 2009/072524 | 6/2009 |
| WO | 2009/090921 | 7/2009 |
| WO | 2009/119505 | 10/2009 |
| WO | 2010/041689 | 4/2010 |
| WO | 2010/041692 | 4/2010 |

OTHER PUBLICATIONS

Search Report issued with respect to European Patent Application No. 12008549.3, mailed Feb. 11, 2013.
"The Advent of Modern Hydroprocessing—The Evolution of Base Oil Technology—Part 2", Machinery Lubirication (Retrieved from: http://www.machinerylubrication.com/Read/493/base-oil-technology on May 14, 2012), May 1, 2003, XP55027093.
Search report from E.P.O. that issued with respect to counterpart European Patent Application No. 09819126.5, mailed May 23, 2012.
Search report from E.P.O. that issued with respect to European Patent Application No. 09819223.0, mailed May 23, 2012.
E.P.O. Office action that issued with respect to European Patent Application No. 09723908.1, mail date is Mar. 2, 2012.
English-language translation of International Preliminary Report on Patentability for PCT/JP2009/055667, mailed Nov. 18, 2010.
English-language translation of International Preliminary Report on Patentability for PCT/JP2009/067504, mailed May 26, 2011.
English-language translation of International Preliminary Report on Patentability for PCT/JP2009/067509, mailed May 26, 2011.
English-language translation of International Preliminary Report on Patentability for PCT/JP2010/050916, mailed Apr. 13, 2012.
English-language translation of International Preliminary Report on Patentability for PCT/JP2010/050921, mailed Jan. 26, 2012.
English-language translation of International Preliminary Report on Patentability for PCT/JP2010/057957, mailed Jan. 26, 2012.
English-language translation of International Preliminary Report on Patentability for PCT/JP2010/059196, mailed Jan. 26, 2012.
English-language translation of International Preliminary Report on Patentability for PCT/JP2010/064698, mailed Mar. 29, 2012.
International Search Report for PCT/JP2009/0067504, mailed Dec. 28, 2009.
International Search Report for PCT/JP2009/055667, mailed Jun. 16, 2009.
International Search Report for PCT/JP2010/050916, mailed Apr. 13, 2010.
International Search Report for PCT/JP2010/050921, mailed Apr. 6, 2010.
International Search Report for PCT/JP2010/057957, mailed Aug. 17, 2010.
International Search Report for PCT/JP2010/059196, mailed Aug. 31, 2010.
International Search Report for PCT/JP2010/064698 (English and Japanese), mailed Nov. 2, 2010.
J.P.O. Notice of Information Provision issued with respect to Japanese Patent Application No. 2008-078224, mailed May 15, 2012.
E.P.O. Search report from E.P.O. that issued with respect to European Patent Application No. 09723908.1, mailed Jun. 29, 2011.
Sharma et al., "Predicting Low Temperature Lubricant Rheology Using Nuclear Magnetic Resonance Spectroscopy and Mass Spectrometry", Tribology Letters, vol. 16, No. 1-2, Feb. 2004, pp. 11-19.
Shinya Sato et al., "Separation of n-Paraffin and 1-Olefin in Shale Oil by Urea Adduct Method", Sekiyu Gakkaishi, vol. 39, No. 5, 1996, pp. 365-368 with partial English language translation.
English-language translation of International Preliminary Report on Patentability for PCT/JP2009/050233, mailed Jul. 29, 2010.
J.P.O. Notification of Information Provision issued with respect to patent family member Japanese Patent Application No. 2008-261070, mailed Jun. 26, 2012.
E.P.O. Search Report issued with respect to European Patent Application No. 09819226.3, mailed Jun. 21, 2012.
J.P.O. Notification of Information Provision issued with respect to Japanese Patent Application No. 2008-078570, mailed May 22, 2012.
E.P.O. Search Report issued with respect to European Patent Application No. 09701700.8, mailed Jul. 5, 2012.
Search Report issued with respect to European Patent Application No. 12002743.8, mailed Aug. 16, 2012.
Search Report issued with respect to European Patent Application No. 12002744.6, mailed Aug. 16, 2012.
Office Action issued with respect to Indonesian Patent Application No. W00201003649, mailed Aug. 23, 2012.
Office Action issued with respect to Chinese Patent Application No. 200980110123.8, mailed Aug. 31, 2012.
Office Action issued with respect to Chinese Patent Application No. 200980110437.8, mailed Aug. 31, 2012.
Office Action issued with respect to European Patent Application No. 09723908.1, mailed Sep. 12, 2012.
Zimmerschied et al., "Crystalline Adducts of Urea with Linear Aliphatic Compounds", Industrial and Engineering Chemistry 42(7), Jul. 31, 1950, pp. 1300-1306.
Rowe et al., "Low-Temperature Performance Advantages for Oils Using Hydrodewaxed Base Stocks", SAE Technical Paper Series 831715, Jan. 1, 1983, pp. 1-14.
Speight, "Hydrocarbons from Petroleum", Handbook of Industrial Hydrocarbon Processes, Jan. 1, 2011, pp. 85-126.
U.S. Appl. No. 13/122,600 to Kazuo Tagawa et al., filed Apr. 5, 2011.
U.S. Appl. No. 13/122,828 to Teppei Tsujimoto et al., filed Apr. 6, 2011.
International Prelimiinary Examination Report from Japan, mail date is May 26, 2011.
Notification of Information Provision issued with respect to Japanese Patent Application No. 2009-135369, mailed May 29, 2012.
Notification of Information Provision issued with respect to Japanese Patent Application No. 2009-135444, mailed Jun. 19, 2012.
Notification of Information Provision issued with respect to Japanese Patent Application No. 2008-261071, mailed Oct. 9, 2012.
Notification of Information Provision issued with respect to Japanese Patent Application No. 2008-261079, mailed Oct. 9, 2012.
Office Action issued with respect to Japanese Patent Application No. 2008-006024, mailed Dec. 4, 2012.
Office Action issued with respect to U.S. Appl. No. 12/812,524, mailed Aug. 28, 2012.
Search Report issued with respect to European Patent Application No. 10783178.6, mailed Oct. 29, 2012.
English-language translation of International Preliminary Report on Patentability issued with respect to PCT/JP2009/055666, mailed Nov. 18, 2010.
English-language translation of International Preliminary Report on Patentability issued with respect to PCT/JP2009/055690, mailed Nov. 18, 2010.
Japanese Office Action issued with respect to Japanese Patent Application No. 2008-261070, dated Jul. 2, 2013.
Office Action issued with respect to U.S. Appl. No. 13/122,828, mailed Feb. 28, 2013.
Office Action issued with respect to U.S. Appl. No. 12/934,374, mailed Mar. 25, 2013.
Office Action issued with respect to Chinese Patent Application No. 200980110123.8, mailed Apr. 1, 2013.
Schiessler et al., "Urea and Thiourea Adduction of $C_5$-$C_{42}$-Hydrocarbons", *Journal of the American Chemical Society*, vol. 74, No. 7, pp. 1720-1723, Apr. 5, 1952.
Hiroshi Ohtsuka et al., "Separation of Straight—Chain Hydrocarbons from Petroleum Fractions by Means of Urea—Adduct Formation", Bulletin of the Faculty of Engineering, Hokkaido University, 40, Mar. 30, 1966, pp. 125-137, along with a partial English-language translation.

(56) References Cited

OTHER PUBLICATIONS

Yozo Oshima et al., "Monomethylparaffins in n-Paraffins Adducted from Petroleum Fractions", Sekiyu Gakkaishi, vol. 18, No. 6, 1975, pp. 497-502, along with a partial English-language translation.
Notification of Information Provision issued with respect to Japanese Patent App. No. 2008-261079, mailed Mar. 12, 2013.
Notification of Information Provision issued with respect to Japanese Patent App. No. 2008-006024, mailed May 14, 2013.
Japanese Office Action issued with respect to Japanese Patent Application No. 2008-261079, dated May 21, 2013.
Japanese Office Action issued with respect to Japanese Patent Appl. No. 2009-135369, dated Jul. 16, 2013.
Yamada et al., "[R2. 1. 4] Summary of Proceedings for the 18$^{th}$ Report on Research Outcomes from Technical Development" Petroleum Energy Center (PEC), Jun. 2004, along with a partial English language translation.
Notification of Information Provision issued with respect to Japanese Patent App. 2008-261070, mailed Oct. 29, 2013.
Notification of Information Provision in relation to JP Patent Application No. 2008-261070, dated Nov. 12, 2013.

* cited by examiner

LUBRICANT BASE OIL AND A PROCESS FOR PRODUCING THE SAME, AND LUBRICATING OIL COMPOSITION

TECHNICAL FIELD

The present invention relates to a lubricating base oil, a process for producing it, and a lubricating oil composition.

BACKGROUND ART

In the field of lubricating oils, additives such as pour point depressants have conventionally been added to lubricating base oils including highly refined mineral oils, to improve the properties such as the low-temperature viscosity characteristics of the lubricating oils (see Patent documents 1-3, for example). Known methods for producing high-viscosity-index base oils include methods in which feed stock oils containing natural or synthetic normal paraffins are subjected to lubricating base oil refining by hydrocracking/hydroisomerization (see Patent documents 4-6, for example).

The properties evaluated for the low-temperature viscosity characteristics of lubricating base oils and lubricating oils are generally the pour point, clouding point and freezing point. Methods are also known for evaluating the low-temperature viscosity characteristics for lubricating base oils according to their normal paraffin or isoparaffin contents.

CITATION LIST

Patent Literature

[Patent document 1] Japanese Unexamined Patent Application Publication HEI No. 4-36391

[Patent document 2] Japanese Unexamined Patent Application Publication HEI No. 4-68082

[Patent document 3] Japanese Unexamined Patent Application Publication HEI No. 4-120193

[Patent document 4] Japanese Unexamined Patent Application Publication No. 2005-154760

[Patent document 5] Japanese Patent Public Inspection No. 2006-502298

[Patent document 6] Japanese Patent Public Inspection No. 2002-503754

SUMMARY OF INVENTION

Technical Problem

However, with demands increasing in recent years for improved low-temperature viscosity characteristics of lubricating oils and also both low-temperature viscosity characteristics and viscosity-temperature characteristics, it has been difficult to completely satisfy such demands even when using lubricating base oils judged to have satisfactory low-temperature performance based on conventional evaluation standards.

Including additives in lubricating base oils can result in some improvement in the properties, but this approach has had its own restrictions. Pour point depressants, in particular, do not exhibit effects proportional to the amounts in which they are added, and even reduce shear stability when added in large amounts.

It has also been attempted to optimize the conditions for hydrocracking/hydroisomerization in refining processes for lubricating base oils that make use of hydrocracking/hydroisomerization as mentioned above, from the viewpoint of increasing the isomerization rate from normal paraffins to isoparaffins and improving the low-temperature viscosity characteristic by lowering the viscosity of the lubricating base oil, but because the viscosity-temperature characteristic (especially high-temperature viscosity characteristic) and the low-temperature viscosity characteristic are in an inverse relationship, it has been extremely difficult to achieve both of these. For example, increasing the isomerization rate from normal paraffins to isoparaffins improves the low-temperature viscosity characteristic but results in an unsatisfactory viscosity-temperature characteristic, including a reduced viscosity index. The fact that the above-mentioned indexes such as pour point and freezing point are often unsuitable as indexes for evaluating the low-temperature viscosity characteristic of lubricating base oils is another factor that impedes optimization of the hydrocracking/hydroisomerization conditions.

From the viewpoint of environmental considerations, on the other hand, improvement in the evaporation property and energy efficiency of lubricating base oils is a desired goal. Particularly in fields such as internal combustion engine lubricating oils, there is a demand for improved evaporation properties and increased fuel efficiency to minimize adverse effects of exhaust gas on catalysts. The fuel efficiency effect can be increased by reducing the viscous resistance of the base oil itself, in addition to the viscosity index of the base oil. The friction resistance is the viscous resistance with an oil film, between cam followers or on a slide bearing, and a lower friction resistance can be considered a higher fuel efficiency effect.

The present invention has been accomplished in light of these circumstances, and it is an object of the invention to provide a lubricating base oil capable of exhibiting high levels of both viscosity-temperature characteristic and low-temperature viscosity characteristic, and superior from the viewpoint of evaporation property and energy efficiency, as well as a process for producing it, and a lubricating oil composition comprising the lubricating base oil.

Solution to Problem

In order to solve the problems described above, the invention provides a hydrocarbon-based lubricating base oil having (i) a urea adduct value of not greater than 4% by mass, (ii) a viscosity index of 100 or greater, and (iii) a cycloparaffin content of 30-60% by mass based on the total amount of the saturated components, as measured by field desorption/ionization mass spectrometry.

The "urea adduct value" according to the invention is measured by the following method. A 100 g weighed portion of sample oil (lubricating base oil) is placed in a round bottom flask, 200 g of urea, 360 ml of toluene and 40 ml of methanol are added and the mixture is stirred at room temperature for 6 hours. This produces white particulate crystals in the reaction mixture. The reaction mixture is filtered with a 1 micron filter to obtain the produced white particulate crystals, and the crystals are washed 6 times with 50 ml of toluene. The recovered white crystals are placed in a flask, 300 ml of purified water and 300 ml of toluene are added and the mixture is stirred at 80° C. for 1 hour. The aqueous phase is separated and removed with a separatory funnel, and the toluene phase is washed 3 times with 300 ml of purified water. After dewatering treatment of the toluene phase by addition of a desiccant (sodium sulfate), the toluene is distilled off. The proportion (mass percentage) of hydrocarbon component (urea adduct) obtained in this manner with respect to the sample oil is defined as the urea adduct value.

While efforts are being made to improve the isomerization rate from normal paraffins to isoparaffins in conventional refining processes for lubricating base oils by hydrocracking and hydroisomerization, as mentioned above, the present inventors have found that it is difficult to satisfactorily improve the low-temperature viscosity characteristic simply by reducing the residual amount of normal paraffins. That is, although the isoparaffins produced by hydrocracking and hydroisomerization also contain components that adversely affect the low-temperature viscosity characteristic, this fact has not been fully appreciated in the conventional methods of evaluation.

With measurement of the urea adduct value according to the invention, on the other hand, it is possible to accomplish precise and reliable collection of the components in isoparaffins that can adversely affect the low-temperature viscosity characteristic, as well as normal paraffins when normal paraffins are residually present in the lubricating base oil, as urea adduct, and it is therefore an excellent indicator for evaluation of the low-temperature viscosity characteristic of lubricating base oils. The present inventors have confirmed that when analysis is conducted using GC and NMR, the main urea adducts are urea adducts of normal paraffins and of isoparaffins having carbon atoms from a terminal carbon atom of a main chain to a point of branching of 6 or greater.

The "viscosity index" according to the invention, and the "kinematic viscosity at 40° C. or 100° C." mentioned hereunder, are the viscosity index and kinematic viscosity at 40° C. or 100° C. as measured according to JIS K 2283-1993.

"Field desorption/ionization mass spectrometry" according to the invention is mass spectrometry performed by FD (Field Desorption). FD is an ionization method wherein a sample is coated onto an emitter, a current is applied to the emitter to heat the coated sample, and a tunnel effect is utilized in the high electric field on the emitter surface and near the whisker tip. For the invention, JMS-AX505H by JEOL Corp. was used for measurement under conditions with an acceleration voltage (cathode voltage) of 3.0 kV and an emitter current of 2 mA/min. Compound types in mass spectrometry are determined by the characteristic ions formed, and they are generally classified by z value. The z value is represented in the general formula $C_nH_{2n+z}$ for all hydrocarbons. Since the saturated phase is analyzed separately from the aromatic phase, it is possible to measure the contents of different cycloparaffins with the same stoichiometry. Cycloparaffins include monocyclic cycloparaffins and bicyclic and greater cycloparaffins.

A hydrocarbon-based lubricating base oil of the invention (also hereinafter referred to as "lubricating base oil of the invention") satisfies the aforementioned conditions (i)-(iii) and therefore allows high levels of both viscosity-temperature characteristic and low-temperature viscosity characteristic to be obtained. When an additive such as a pour point depressant is added to the lubricating base oil of the invention, the effect of its addition is exhibited more effectively. Thus, the lubricating base oil of the invention is highly useful as a lubricating base oil that can meet recent demands in terms of both low-temperature viscosity characteristic and viscosity-temperature characteristic. In addition, according to the lubricating base oil of the invention it is possible to reduce viscous resistance and stirring resistance in a practical temperature range due to its aforementioned superior viscosity-temperature characteristic. In particular, the lubricating base oil of the invention can exhibit this effect by significantly reducing viscous resistance and stirring resistance under low temperature conditions of 0° C. and below, and it is therefore highly useful for reducing energy loss and achieving energy savings in devices in which the lubricating base oil is applied.

Moreover, the invention provides a method for producing a lubricating base oil comprising a step of hydrocracking/hydroisomerization of a feed stock oil containing normal paraffins so as to obtain a treated product having (i) a urea adduct value of not greater than 4% by mass, (ii) a viscosity index of 100 or higher, and (iii) a cycloparaffin content of 30-60% by mass based on the total amount of the saturated components, as measured by field desorption/ionization mass spectrometry.

According to the method for producing a lubricating base oil according to the invention, it is possible to reliably obtain a lubricating base oil with high levels of both viscosity-temperature characteristic and low-temperature viscosity characteristic, and having improved evaporation properties and energy efficiency, by hydrocracking/hydroisomerization of a feed stock oil containing normal paraffins so as to obtain the treated product satisfies the aforementioned conditions (i)-(iii).

The invention still further provides a lubricating oil composition comprising the aforementioned lubricating base oil of the invention.

Since a lubricating oil composition according to the invention contains a lubricating base oil of the invention having the excellent properties described above, it is useful as a lubricating oil composition capable of exhibiting high levels of both viscosity-temperature characteristic and low-temperature viscosity characteristic, and with excellence in terms of evaporation property and energy efficiency. Moreover, since the effects of adding additives to the lubricating base oil of the invention can be effectively exhibited, as explained above, various additives may be optimally added to the lubricating oil composition of the invention.

Advantageous Effects of Invention

According to the invention there are provided a lubricating base oil capable of exhibiting high levels of both viscosity-temperature characteristic and low-temperature viscosity characteristic, and having excellence in terms of evaporation property and energy efficiency, as well as a method for producing it, and a lubricating oil composition comprising the lubricating base oil.

DESCRIPTION OF EMBODIMENTS

Preferred embodiments of the invention will now be described in detail.

The lubricating base oil of the invention is a hydrocarbon-based lubricating base oil having (i) a urea adduct value of not greater than 4% by mass, (ii) a viscosity index of 100 or greater, and (iii) a cycloparaffin content of 30-60% by mass as measured by field desorption/ionization mass spectrometry.

Also, from the viewpoint of improving the low-temperature viscosity characteristic without impairing the viscosity-temperature characteristic, the urea adduct value of the lubricating base oil of the invention must be not greater than 4% by mass as mentioned above, but it is preferably not greater than 3.5% by mass, more preferably not greater than 3% by mass and even more preferably not greater than 2.5% by mass. The urea adduct value of the lubricating base oil may even be 0% by mass. However, it is preferably 0.1% by mass or greater, more preferably 0.5% by mass or greater and most preferably 0.8% by mass or greater, from the viewpoint of obtaining a lubricating base oil with a sufficient low-temperature viscosity characteristic and a higher viscosity index, and also of relaxing the dewaxing conditions for increased economy.

Also, from the viewpoint of improving the viscosity-temperature characteristic, the viscosity index of the lubricating base oil of the invention must be 100 or greater as mentioned above, but it is preferably 110 or greater, more preferably 120 or greater, even more preferably 130 or greater and most preferably 140 or greater.

The cycloparaffin content of the lubricating base oil of the invention, as measured by field desorption/ionization mass spectrometry, must be 30-60% by mass based on the total amount of the saturated components, as mentioned above, but it is preferably 35-60% by mass and more preferably 40-60% by mass. A cycloparaffin content of less than 30% by mass will reduce the low-temperature characteristics, while a content of greater than 60% by mass may impair the viscosity-temperature characteristic. The cycloparaffin content of the lubricating base oil of the invention is 30-55% by mass and preferably 35-55% by mass based on the total amount of the saturated components, from the standpoint of allowing the viscous resistance to be further reduced, the cycloparaffin content is 40-60% by mass and preferably 45-60% by mass from the standpoint of allowing further improvement in the low-temperature characteristics, and the cycloparaffin content is preferably 45-55% by mass from the standpoint of achieving a balance between both.

The monocyclic cycloparaffin content of the lubricating base oil of the invention is not particularly restricted, but is preferably 5-60% by mass, more preferably 15-57% by mass, even more preferably 25-55% by mass and most preferably 30-52% by mass, based on the total amount of the saturated components.

The bicyclic and greater cycloparaffin content of the lubricating base oil of the invention is also not particularly restricted, but is preferably 0-55% by mass, more preferably 3-45% by mass, even more preferably 5-35% by mass and most preferably 8-30% by mass, based on the total amount of the saturated components.

A cycloparaffin content of 30-60% by mass in the lubricating base oil of the invention based on the total amount of the saturated components, as measured by field desorption/ionization mass spectrometry, is equivalent to an acyclic paraffin content of 70-40% by mass based on the total amount of the saturated components.

The ratio of the acyclic paraffin content (P) to the monocyclic cycloparaffin content (CP1) (P/CP1: mass ratio) in the lubricating base oil of the invention is not particularly restricted, but is preferably 0.5-4.5, more preferably 0.8-3.4 and even more preferably 0.9-3. The ratio of the acyclic paraffin content (P) to the bicyclic and greater cycloparaffin content (CP2+) (P/CP2+: mass ratio) in the lubricating base oil of the invention is also not particularly restricted, but is preferably 2-30, more preferably 2.6-20 and even more preferably 3-10.

By satisfying the aforementioned preferred ranges for the monocyclic cycloparaffin content, the bicyclic and greater cycloparaffin content, the acyclic paraffin content, the ratio between the acyclic paraffin content and the monocyclic cycloparaffin content, and the ratio between the acyclic paraffin content and the bicyclic and greater cycloparaffin content, it is possible to reduce the viscous resistance of the base oil and obtain a lubricating base oil with excellent low-temperature characteristics.

The feed stock oil used for production of the lubricating base oil of the invention may include normal paraffins or normal paraffin-containing wax. The feed stock oil may be a mineral oil or a synthetic oil, or a mixture of two or more thereof.

The feed stock oil used for the invention preferably is a wax-containing starting material that boils in the range of lubricating oils according to ASTM D86 or ASTM D2887. The wax content of the feed stock oil is preferably between 50% by mass and 100% by mass based on the total amount of the feed stock oil. The wax content of the starting material can be measured by a method of analysis such as nuclear magnetic resonance spectroscopy (ASTM D5292), correlative ring analysis (n-d-M) (ASTM D3238) or the solvent method (ASTM D3235).

Examples of wax-containing starting materials include oils derived from solvent refining methods, such as raffinates, partial solvent dewaxed oils, deasphalted oils, distillates, vacuum gas oils, coker gas oils, slack waxes, foot oil, Fischer-Tropsch waxes and the like, among which slack waxes and Fischer-Tropsch waxes are preferred.

Slack wax is typically derived from hydrocarbon starting materials by solvent or propane dewaxing. Slack waxes may contain residual oil, but the residual oil can be removed by deoiling. Foot oil corresponds to deoiled slack wax.

Fischer-Tropsch waxes are produced by so-called Fischer-Tropsch synthesis.

Commercial normal paraffin-containing feed stock oils are also available. Specifically, these include Paraflint 80 (hydrogenated Fischer-Tropsch wax) and Shell MDS Waxy Raffinate (hydrogenated and partially isomerized heart cut distilled synthetic wax raffinate).

Feed stock oil from solvent extraction is obtained by feeding a high boiling point petroleum fraction from atmospheric distillation to a vacuum distillation apparatus and subjecting the distillation fraction to solvent extraction. The residue from vacuum distillation may also be depitched. In solvent extraction methods, the aromatic components are dissolved in the extract phase while leaving more paraffinic components in the raffinate phase. Naphthenes are distributed in the extract phase and raffinate phase. The preferred solvents for solvent extraction are phenols, furfurals and N-methylpyrrolidone. By controlling the solvent/oil ratio, extraction temperature and method of contacting the solvent with the distillate to be extracted, it is possible to control the degree of separation between the extract phase and raffinate phase. There may also be used as the starting material a bottom fraction obtained from a fuel oil hydrocracking apparatus, using a fuel oil hydrocracking apparatus with higher hydrocracking performance.

It is possible to obtain a lubricating base oil of the invention by a step of hydrocracking/hydroisomerization of a feed stock oil so as to obtain the treated product satisfies the aforementioned conditions (i)-(iii). The hydrocracking/hydroisomerization step is not particularly restricted so long as it satisfies the aforementioned conditions for the urea adduct value and viscosity index of the treated product. A preferred hydrocracking/hydroisomerization step according to the invention comprises:

a first step in which a normal paraffin-containing feed stock oil is subjected to hydrotreatment using a hydrocracking catalyst, a second step in which the treated product from the first step is subjected to hydrodewaxing using a hydrodewaxing catalyst, and a third step in which the treated product from the second step is subjected to hydrorefining using a hydrorefining catalyst.

Conventional hydrocracking/hydroisomerization also includes a hydrotreatment step in an early stage of the hydrodewaxing step, for the purpose of desulfurization and denitrogenization to prevent poisoning of the hydrodewaxing catalyst. In contrast, the first step (hydrotreatment step) according to the invention is carried out to decompose a portion (for example, about 10% by mass and preferably 1-10% by mass) of the normal paraffins in the feed stock oil at an early stage of the second step (hydrodewaxing step), thus allowing desulfurization and denitrogenization in the first step as well, although the purpose differs from that of conventional hydrotreatment. The first step is preferred in order to reliably limit the urea adduct value of the treated product obtained after the third step (the lubricating base oil) to not greater than 4% by mass.

As hydrogenation catalysts to be used in the first step there may be mentioned catalysts containing Group 6 metals and Group 8-10 metals, as well as mixtures thereof. Preferred metals include nickel, tungsten, molybdenum and cobalt, and mixtures thereof. The hydrogenation catalyst may be used in a form with the aforementioned metals supported on a heat-resistant metal oxide carrier, and normally the metal will be present on the carrier as an oxide or sulfide. When a mixture of metals is used, it may be used as a bulk metal catalyst with an amount of metal of at least 30% by mass based on the total amount of the catalyst. The metal oxide carrier may be an oxide such as silica, alumina, silica-alumina or titania, with alumina being preferred. Preferred alumina is γ or β porous alumina. The loading amount of the metal is preferably 0.5-35% by mass based on the total amount of the catalyst. When a mixture of a metal of Groups 9-10 and a metal of Group 6 is used, preferably the metal of Group 9 or 10 is present in an amount of 0.1-5% by mass and the metal of Group 6 is present in an amount of 5-30% by mass based on the total amount of the catalyst. The loading amount of the metal may be measured by atomic absorption spectrophotometry or inductively coupled plasma emission spectroscopy, or the individual metals may be measured by other ASTM methods.

The acidity of the metal oxide carrier can be controlled by controlling the addition of additives and the nature of the metal oxide carrier (for example, controlling the amount of silica incorporated in a silica-alumina carrier). As examples of additives there may be mentioned halogens, especially fluorine, and phosphorus, boron, yttria, alkali metals, alkaline earth metals, rare earth oxides and magnesia. Co-catalysts such as halogens generally raise the acidity of metal oxide carriers, while weakly basic additives such as yttria and magnesia can be used to lower the acidity of the carrier.

As regards the hydrotreatment conditions, the treatment temperature is preferably 150-450° C. and more preferably 200-400° C., the hydrogen partial pressure is preferably 1400-20,000 kPa and more preferably 2800-14,000 kPa, the liquid space velocity (LHSV) is preferably 0.1-10 $h^{-1}$ and more preferably 0.1-5 $hr^{-1}$, and the hydrogen/oil ratio is preferably 50-1780 $m^3/m^3$ and more preferably 89-890 $m^3/m^3$. These conditions are only for example, and the hydrotreatment conditions in the first step may be appropriately selected for different starting materials, catalysts and apparatuses, in order to obtain the specified urea adduct value and viscosity index for the treated product obtained after the third step.

The treated product obtained by hydrotreatment in the first step may be directly supplied to the second step, but a step of stripping or distillation of the treated product and separating removal of the gas product from the treated product (liquid product) is preferably conducted between the first step and second step. This can reduce the nitrogen and sulfur contents in the treated product to levels that will not affect prolonged use of the hydrodewaxing catalyst in the second step. The main objects of separating removal by stripping and the like are gaseous contaminants such as hydrogen sulfide and ammonia, and stripping can be accomplished by ordinary means such as a flash drum, distiller or the like.

When the hydrotreatment conditions in the first step are mild, residual polycyclic aromatic components can potentially remain depending on the starting material used, and such contaminants may be removed by hydrorefining in the third step.

The hydrodewaxing catalyst used in the second step may contain crystalline or amorphous materials. As examples of crystalline materials there may be mentioned molecular sieves having 10- or 12-membered ring channels, composed mainly of aluminosilicates (zeolite) or silicoaluminophosphates (SAPO). Specific examples of zeolites include ZSM-22, ZSM-23, ZSM-35, ZSM-48, ZSM-57, ferrierite, ITQ-13, MCM-68, MCM-71 and the like. ECR-42 may be mentioned as an example of an aluminophosphate. Examples of molecular sieves include zeolite beta and MCM-68. Among the above there are preferably used one or more selected from among ZSM-48, ZSM-22 and ZSM-23, with ZSM-48 being particularly preferred. The molecular sieves are preferably hydrogen-type. Reduction of the hydrodewaxing catalyst may occur at the time of hydrodewaxing, but alternatively a hydrodewaxing catalyst that has been previously subjected to reduction treatment may be used for the hydrodewaxing.

Amorphous materials for the hydrodewaxing catalyst include alumina doped with Group 3 metals, fluorinated alumina, silica-alumina, fluorinated silica-alumina, silica-alumina and the like.

A preferred mode of the dewaxing catalyst is a bifunctional catalyst, i.e. one carrying a metal hydrogenated component which is at least one metal of Group 6, at least one metal of Groups 8-10 or a mixture thereof. Preferred metals are precious metals of Groups 9-10, such as Pt, Pd or mixtures thereof. Such metals are supported at preferably 0.1-30% by mass based on the total amount of the catalyst. The method for preparation of the catalyst and loading of the metal may be, for example, an ion-exchange method or impregnation method using a decomposable metal salt.

When molecular sieves are used, they may be compounded with a binder material that is heat resistant under the hydrodewaxing conditions, or they may be binderless (self-binding). As binder materials there may be mentioned inorganic oxides, including silica, alumina, silica-alumina, two-component combinations of silica with other metal oxides such as titania, magnesia, yttria and zirconia, and three-component combinations of oxides such as silica-alumina-yttria, silica-alumina-magnesia and the like. The amount of molecular sieves in the hydrodewaxing catalyst is preferably 10-100% by mass and more preferably 35-100% by mass based on the total amount of the catalyst. The hydrodewaxing catalyst may be formed by a method such as spray-drying or extrusion. The hydrodewaxing catalyst may be used in sulfided or non-sulfided form, although a sulfided form is preferred.

As regards the hydrodewaxing conditions, the temperature is preferably 250-400° C. and more preferably 275-350° C., the hydrogen partial pressure is preferably 791-20,786 kPa (100-3000 psig) and more preferably 1480-17,339 kPa (200-2500 psig), the liquid space velocity is preferably 0.1-10 $hr^{-1}$ and more preferably 0.1-5 $hr^{-1}$, and the hydrogen/oil ratio is preferably 45-1780 $m^3/m^3$ (250-10,000 scf/B) and more preferably 89-890 $m^3/m^3$ (500-5000 scf/B). These conditions are only for example, and the hydrodewaxing conditions in the second step may be appropriately selected for different starting materials, catalysts and apparatuses, in order to obtain the specified urea adduct value and viscosity index for the treated product obtained after the third step.

The treated product that has been hydrodewaxed in the second step is then supplied to hydrorefining in the third step. Hydrorefining is a form of mild hydrotreatment aimed at removing residual heteroatoms and color components while also saturating the olefins and residual aromatic compounds by hydrogenation. The hydrorefining in the third step may be carried out in a cascade fashion with the dewaxing step.

The hydrorefining catalyst used in the third step is preferably one comprising a Group 6 metal, a Group 8-10 metal or a mixture thereof supported on a metal oxide support. As preferred metals there may be mentioned precious metals, and especially platinum, palladium and mixtures thereof. When a mixture of metals is used, it may be used as a bulk metal catalyst with an amount of metal of 30% by mass or greater based on the amount of the catalyst. The metal content of the catalyst is preferably not greater than 20% by mass non-precious metals and preferably not greater than 1% by mass precious metals. The metal oxide support may be either an amorphous or crystalline oxide. Specifically, there may be mentioned low acidic oxides such as silica, alumina, silica-alumina and titania, with alumina being preferred. From the viewpoint of saturation of aromatic compounds, it is preferred to use a hydrorefining catalyst comprising a metal with a relatively powerful hydrogenating function supported on a porous carrier.

Preferred hydrorefining catalysts include meso-microporous materials belonging to the M41S class or line of catalysts. M41S line catalysts are meso-microporous materials with high silica contents, and specific ones include MCM-41, MCM-48 and MCM-50. The hydrorefining catalyst has a pore size of 15-100 Å, and MCM-41 is particularly preferred. MCM-41 is an inorganic porous non-laminar phase with a hexagonal configuration and pores of uniform size. The physical structure of MCM-41 manifests as straw-like bundles with straw openings (pore cell diameters) in the range of 15-100 angstroms. MCM-48 has cubic symmetry, while MCM-50 has a laminar structure. MCM-41 may also have a structure with pore openings having different meso-microporous ranges. The meso-microporous material may contain metal hydrogenated components consisting of one or more Group 8, 9 or 10 metals, and preferred as metal hydrogenated components are precious metals, especially Group 10 precious metals, and most preferably Pt, Pd or their mixtures.

As regards the hydrorefining conditions, the temperature is preferably 150-350° C. and more preferably 180-250° C., the total pressure is preferably 2859-20,786 kPa (approximately 400-3000 psig), the liquid space velocity is preferably 0.1-5 $hr^{-1}$ and more preferably 0.5-3 $hr^{-1}$, and the hydrogen/oil ratio is preferably 44.5-1780 $m^3/m^3$ (250-10,000 scf/B). These conditions are only for example, and the hydrorefining conditions in the third step may be appropriately selected for different starting materials and treatment apparatuses, so that the urea adduct value and viscosity index for the treated product obtained after the third step satisfy the respective conditions specified above.

The treated product obtained after the third step may be subjected to distillation or the like as necessary for separating removal of certain components.

The lubricating base oil of the invention obtained by the production process described above is not restricted in terms of its other properties so long as the aforementioned conditions (i)-(iii) are satisfied, but the lubricating base oil of the invention preferably also satisfies the conditions specified below.

The saturated component content of the lubricating base oil of the invention is preferably 90% by mass or greater, more preferably 93% by mass or greater and even more preferably 95% by mass or greater based on the total amount of the lubricating base oil. The proportion of cyclic saturated components among the saturated components is preferably 0.1-50% by mass, more preferably 0.5-40% by mass, even more preferably 1-30% by mass and most preferably 5-20% by mass. If the saturated component content and proportion of cyclic saturated components among the saturated components both satisfy these respective conditions, it will be possible to achieve adequate levels for the viscosity-temperature characteristic and heat and oxidation stability, while additives added to the lubricating base oil will be kept in a sufficiently stable dissolved state in the lubricating base oil, and it will be possible for the functions of the additives to be exhibited at a higher level. In addition, a saturated component content and proportion of cyclic saturated components among the saturated components satisfying the aforementioned conditions can improve the frictional properties of the lubricating base oil itself, resulting in a greater friction reducing effect and thus increased energy savings.

If the saturated component content is less than 90% by mass, the viscosity-temperature characteristic, heat and oxidation stability and frictional properties will tend to be inadequate. If the proportion of cyclic saturated components among the saturated components is less than 0.1% by mass, the solubility of the additives included in the lubricating base oil will be insufficient and the effective amount of additives kept dissolved in the lubricating base oil will be reduced, making it impossible to effectively achieve the function of the additives. If the proportion of cyclic saturated components among the saturated components is greater than 50% by mass, the efficacy of additives included in the lubricating base oil will tend to be reduced.

According to the invention, a proportion of 0.1-50% by mass cyclic saturated components among the saturated components is equivalent to 99.9-50% by mass acyclic saturated components among the saturated components. Both normal paraffins and isoparaffins are included by the term "acyclic saturated components". The proportions of normal paraffins and isoparaffins in the lubricating base oil of the invention are not particularly restricted so long as the urea adduct value satisfies the condition specified above, but the proportion of isoparaffins is preferably 50-99.9% by mass, more preferably 60-99.9% by mass, even more preferably 70-99.9% by mass and most preferably 80-99.9% by mass based on the total amount of the lubricating base oil. If the proportion of isoparaffins in the lubricating base oil satisfies the aforementioned conditions it will be possible to further improve the viscosity-temperature characteristic and heat and oxidation stability, while additives added to the lubricating base oil will be kept in a sufficiently stable dissolved state in the lubricating base oil and it will be possible for the functions of the additives to be exhibited at an even higher level.

The saturated component content for the purpose of the invention is the value measured according to ASTM D 2007-93 (units: % by mass).

The proportions of the cyclic saturated components and acyclic saturated components among the saturated components for the purpose of the invention are the naphthene portion (measured: monocyclic-hexacyclic naphthenes, units: % by mass) and alkane portion (units: % by mass), respectively, both measured according to ASTM D 2786-91.

The proportion of normal paraffins in the lubricating base oil for the purpose of the invention is the value obtained by analyzing saturated components separated and fractionated by the method of ASTM D 2007-93 by gas chromatography under the following conditions, and calculating the value obtained by identifying and quantifying the proportion of normal paraffins among those saturated components, with respect to the total amount of the lubricating base oil. For identification and quantitation, a C5-50 straight-chain normal paraffin mixture sample is used as the reference sample, and the normal paraffin content among the saturated components is determined as the proportion of the total of the peak areas corresponding to each normal paraffin, with respect to the total peak area of the chromatogram (subtracting the peak area for the diluent).

(Gas Chromatography Conditions)

Column: Liquid phase nonpolar column (length: 25 m, inner diameter: 0.3 mmϕ, liquid phase film thickness: 0.1 μm), temperature elevating conditions: 50° C.-400° C. (temperature-elevating rate: 10° C./min).

Carrier gas: helium (linear speed: 40 cm/min)

Split ratio: 90/1

Sample injection rate: 0.5 μL (injection rate of sample diluted 20-fold with carbon disulfide).

The proportion of isoparaffins in the lubricating base oil is the value of the difference between the acyclic saturated components among the saturated components and the normal paraffins among the saturated components, based on the total amount of the lubricating base oil.

Other methods may be used for separation of the saturated components or for compositional analysis of the cyclic saturated components and acyclic saturated components, so long as they provide similar results. Examples of other methods include the method according to ASTM D 2425-93, the method according to ASTM D 2549-91, methods of high performance liquid chromatography (HPLC), and modified forms of these methods.

When the bottom fraction obtained from a fuel oil hydrocracker is used as the starting material for the lubricating base oil of the invention, the obtained base oil will have a saturated component content of 90% by mass or greater, a proportion of cyclic saturated components in the saturated components of 30-50% by mass, a proportion of acyclic saturated components in the saturated components of 50-70% by mass, a proportion of isoparaffins in the lubricating base oil of 40-70% by mass and a viscosity index of 100-135 and preferably 120-130, but if the urea adduct value satisfies the conditions specified above it will be possible to obtain a lubricating oil composition with the effect of the invention, i.e. an excellent low-temperature viscosity characteristic wherein the MRV viscosity at −40° C. is not greater than 20,000 mPa·s and especially not greater than 10,000 mPa·s. When a slack wax or Fischer-Tropsch wax having a high wax content (for example, a normal paraffin content of 50% by mass or greater) is used as the starting material for the lubricating base oil of the invention, the obtained base oil will have a saturated component content of 90% by mass or greater, a proportion of cyclic saturated components in the saturated components of 0.1-40% by mass, a proportion of acyclic saturated components in the saturated components of 60-99.9% by mass, a proportion of isoparaffins in the lubricating base oil of 60-99.9% by mass and a viscosity index of 100-170 and preferably 135-160, but if the urea adduct value satisfies the conditions specified above it will be possible to obtain a lubricating oil composition with very excellent properties in terms of the effect of the invention, and especially the high viscosity index and low-temperature viscosity characteristic, wherein the MRV viscosity at −40° C. is not greater than 12,000 mPa·s and especially not greater than 7000 mPa·s.

The aromatic content of the lubricating base oil of the invention is preferably not greater than 5% by mass, more preferably 0.05-3% by mass, even more preferably 0.1-1% by mass and most preferably 0.1-0.5% by mass based on the total amount of the lubricating base oil. If the aromatic content exceeds the aforementioned upper limit, the viscosity-temperature characteristic, heat and oxidation stability, frictional properties, low volatility and low-temperature viscosity characteristic will tend to be reduced, while the efficacy of additives when added to the lubricating base oil will also tend to be reduced. The lubricating base oil of the invention may be free of aromatic components, but the solubility of additives can be further increased with an aromatic content of 0.05% by mass or greater.

The aromatic content in this case is the value measured according to ASTM D 2007-93. The aromatic portion normally includes alkylbenzenes and alkylnaphthalenes, as well as anthracene, phenanthrene and their alkylated forms, compounds with four or more fused benzene rings, and heteroatom-containing aromatic compounds such as pyridines, quinolines, phenols, naphthols and the like.

The % $C_p$ value of the lubricating base oil of the invention is preferably 80 or greater, more preferably 82-99, even more preferably 85-98 and most preferably 90-97. If the % $C_P$ value of the lubricating base oil is less than 80, the viscosity-temperature characteristic, heat and oxidation stability and frictional properties will tend to be reduced, while the efficacy of additives when added to the lubricating base oil will also tend to be reduced. If the % $C_p$ value of the lubricating base oil is greater than 99, on the other hand, the additive solubility will tend to be lower.

The % $C_N$ value of the lubricating base oil of the invention is preferably not greater than 20, more preferably not greater than 15, even more preferably 1-12 and most preferably 3-10. If the % $C_N$ value of the lubricating base oil exceeds 20, the viscosity-temperature characteristic, heat and oxidation stability and frictional properties will tend to be reduced. If the % $C_N$ is less than 1, however, the additive solubility will tend to be lower.

The % $C_A$ value of the lubricating base oil of the invention is preferably not greater than 0.7, more preferably not greater than 0.6 and even more preferably 0.1-0.5. If the % $C_A$ value of the lubricating base oil exceeds 0.7, the viscosity-temperature characteristic, heat and oxidation stability and frictional properties will tend to be reduced. The % $C_A$ value of the lubricating base oil of the invention may be zero, but the solubility of additives can be further increased with a % $C_A$ value of 0.1 or greater.

The ratio of the % $C_P$ and % $C_N$ values for the lubricating base oil of the invention is % $C_P$/% $C_N$ of preferably 7 or greater, more preferably 7.5 or greater and even more preferably 8 or greater. If the % $C_P$/% $C_N$ ratio is less than 7, the viscosity-temperature characteristic, heat and oxidation stability and frictional properties will tend to be reduced, while the efficacy of additives when added to the lubricating base oil will also tend to be reduced. The % $C_P$/% $C_N$ ratio is preferably not greater than 200, more preferably not greater than 100, even more preferably not greater than 50 and most preferably not greater than 25. The additive solubility can be further increased if the % $C_P$/% $C_N$ ratio is not greater than 200.

The % $C_P$, % $C_N$ and % $C_A$ values for the purpose of the invention are, respectively, the percentage of paraffinic carbons with respect to total carbon atoms, the percentage of naphthenic carbons with respect to total carbons and the percentage of aromatic carbons with respect to total carbons, as determined by the method of ASTM D 3238-85 (n-d-M ring analysis). That is, the preferred ranges for % $C_P$, % $C_N$ and % $C_A$ are based on values determined by these methods, and for example, % $C_N$ may be a value exceeding 0 according to these methods even if the lubricating base oil contains no naphthene portion.

The iodine value of the lubricating base oil of the invention is preferably not greater than 0.5, more preferably not greater than 0.3 and even more preferably not greater than 0.15, and although it may be less than 0.01, it is preferably 0.001 or greater and more preferably 0.05 or greater in consideration of achieving a commensurate effect, and in terms of economy. Limiting the iodine value of the lubricating base oil to not greater than 0.5 can drastically improve the heat and oxidation stability. The "iodine value" for the purpose of the invention is the iodine value measured by the indicator titration method according to JIS K 0070, "Acid Values, Saponification Values, Iodine Values, Hydroxyl Values And Unsaponification Values Of Chemical Products".

The sulfur content in the lubricating base oil of the invention will depend on the sulfur content of the starting material. For example, when using a substantially sulfur-free starting material as for synthetic wax components obtained by Fischer-Tropsch reaction, it is possible to obtain a substantially sulfur-free lubricating base oil. When using a sulfur-containing starting material, such as slack wax obtained by a lubricating base oil refining process or microwax obtained by a wax refining process, the sulfur content of the obtained lubricating base oil can potentially be 100 ppm by mass or greater. From the viewpoint of further improving the heat and oxidation stability and reducing sulfur, the sulfur content in the lubricating base oil of the invention is preferably not greater than 10 ppm by mass, more preferably not greater than 5 ppm by mass and even more preferably not greater than 3 ppm by mass.

From the viewpoint of cost reduction it is preferred to use slack wax or the like as the starting material, in which case the sulfur content of the obtained lubricating base oil is preferably not greater than 50 ppm by mass and more preferably not greater than 10 ppm by mass. The sulfur content for the purpose of the invention is the sulfur content measured according to JIS K 2541-1996.

The nitrogen content in the lubricating base oil of the invention is not particularly restricted, but is preferably not greater than 5 ppm by mass, more preferably not greater than 3 ppm by mass and even more preferably not greater than 1 ppm by mass. If the nitrogen content exceeds 5 ppm by mass, the heat and oxidation stability will tend to be reduced. The nitrogen content for the purpose of the invention is the nitrogen content measured according to JIS K 2609-1990.

The dynamic viscosity of the lubricating base oil of the invention, as the kinematic viscosity at 100° C., is preferably 1.5-20 $mm^2/s$ and more preferably 2.0-11 $mm^2/s$. A kinematic viscosity at 100° C. of below this lower limit for the lubricating base oil is not preferred from the standpoint of evaporation loss. Also, if it is attempted to obtain a lubricating base oil having a kinematic viscosity at 100° C. above the upper limit, the yield will be reduced and it will be difficult to increase the cracking severity even when using a heavy wax as the starting material.

A "SAE10-corresponding" lubricating base oil may be mentioned as a preferred mode of the lubricating base oil of the invention. The kinematic viscosity at 100° C. is preferably 3.6-4.1 $mm^2/s$ and more preferably 3.7-4.0 $mm^2/s$, and the kinematic viscosity at 40° C. is preferably 14.5-17 $mm^2/s$ and more preferably 15-16.5 $mm^2/s$. The preferred properties for an assumed SAE10-corresponding lubricating base oil are the following, although they are not limitative.

The CCS viscosity at −35° C. of the lubricating base oil of the invention is preferably not greater than 3000 mPa·s, more preferably not greater than 2000 mPa·s and even more preferably not greater than 1600 mPa·s. If the CCS viscosity at −35° C. exceeds the upper limit specified above, the low-temperature flow properties of a lubricating oil employing the lubricating base oil will tend to be reduced. The CCS viscosity for the purpose of the invention is the viscosity measured according to JIS K 2010-1993.

The BF viscosity at −25° C. of the lubricating base oil of the invention is preferably not greater than 20,000 mPa·s, more preferably not greater than 10,000 mPa·s, even more preferably not greater than 5000 mPa·s, yet more preferably not greater than 3000 mPa·s and most preferably not greater than 2000 mPa·s. If the BF viscosity exceeds the upper limit specified above, the low-temperature flow properties of a lubricating oil employing the lubricating base oil will tend to be reduced. The BF viscosity is the viscosity measured according to JPI-5S-26-99.

The density at 15° C. ($\rho_{15}$) ($g/cm^3$) of the lubricating base oil of the invention is preferably not greater than the value of $\rho$ as represented by the following formula (1), i.e., $\rho_{15} \leq \rho$.

$$\rho = 0.0025 \times kv100 + 0.816 \quad (1)$$

[In this equation, kv100 represents the kinematic viscosity at 100° C. ($mm^2/s$) of the lubricating base oil.]

If $\rho_{15} > \rho$, the viscosity-temperature characteristic, heat and oxidation stability, low volatility and low-temperature viscosity characteristic of the lubricating base oil will tend to be reduced, while the efficacy of additives when added to the lubricating base oil will also tend to be reduced.

The value of $\rho_{15}$ for the lubricating base oil of the invention is preferably not greater than 0.830 $g/cm^3$, more preferably not greater than 0.825 $g/cm^3$ and more preferably not greater than 0.820 $g/cm^3$.

The density at 15° C. for the purpose of the invention is the density measured at 15° C. according to JIS K 2249-1995.

The aniline point (AP (° C.)) of the lubricating base oil of the invention is preferably greater than or equal to the value of A as represented by the following formula (2), i.e., $AP \geq A$.

$$A = 4.3 \times kv100 + 100 \quad (2)$$

[In this equation, kv100 represents the kinematic viscosity at 100° C. ($mm^2/s$) of the lubricating base oil.]

If $AP < A$, the viscosity-temperature characteristic, heat and oxidation stability, low volatility and low-temperature viscosity characteristic of the lubricating base oil will tend to be reduced, while the efficacy of additives when added to the lubricating base oil will also tend to be reduced.

The AP for the lubricating base oil of the invention is preferably 110° C. or higher and more preferably 115° C. or higher. The aniline point for the purpose of the invention is the aniline point measured according to JIS K 2256-1985.

The NOACK evaporation of the lubricating base oil of the invention is not particularly restricted, but it is preferably 5% by mass or greater, more preferably 8% by mass or greater and even more preferably 10 or greater, and also preferably not greater than 20% by mass, more preferably not greater than 17.5% by mass and even more preferably not greater than 15% by mass. Tithe NOACK evaporation is below the aforementioned lower limit it will tend to be difficult to improve the low-temperature viscosity characteristic. If the NOACK evaporation is above the respective upper limit, the evaporation loss of the lubricating oil will be increased when the lubricating base oil is used as a lubricating oil for an internal combustion engine, and catalyst poisoning will be undesirably accelerated as a result. The NOACK evaporation for the purpose of the invention is the evaporation loss as measured according to ASTM D 5800-95.

For the distillation property of the lubricating base oil of the invention, the initial boiling point (IBP) is preferably 340-410° C., more preferably 350-400° C. and even more preferably 360-390° C. The 10% distillation temperature (T10) is preferably 365-435° C., more preferably 375-425° C. and even more preferably 385-415° C. The 50% running point (T50) is preferably 400-465° C., more preferably 410-455° C. and even more preferably 420-445° C. The 90% running point (T90) is preferably 425-485° C., more preferably 435-475° C. and even more preferably 445-465° C. The final boiling point (FBP) is preferably 455-515° C., more preferably 465-505° C. and even more preferably 475-495° C. T90-T10 is preferably 45-75° C., more preferably 50-70° C. and even more preferably 55-65° C. FBP-IBP is preferably 100-150° C., more preferably 110-140° C. and even more preferably 120-130° C. T10-IBP is preferably 15-55° C., more preferably 25-45° C. and even more preferably 30-40° C. FBP-T90 is preferably 15-65° C., more preferably 20-55° C. and even more preferably 25-45° C.

By setting IBP, T10, T50, T90, FBP, T90-T10, FBP-IBP, T10-IBP and FBP-T90 of the lubricating base oil of the invention to within the preferred ranges specified above, it is possible to further improve the low-temperature viscosity and further reduce the evaporation loss. If the distillation ranges for T90-T10, FBP-IBP, T10-IBP and FBP-T90 are too narrow, the lubricating base oil yield will be poor resulting in low economy.

The IBP, T10, T50, T90 and FBP values for the purpose of the invention are the running points measured according to ASTM D 2887-97.

The residual metal content in the lubricating base oil of the invention derives from metals in the catalyst or starting materials that become unavoidable contaminants during the production process, and it is preferred to thoroughly remove such residual metal contents. For example, the Al, Mo and Ni contents are each preferably not greater than 1 ppm by mass. If the metal contents exceed the aforementioned upper limit, the functions of additives in the lubricating base oil will tend to be inhibited.

The residual metal content for the purpose of the invention is the metal content as measured according to JPI-5S-38-2003.

The RBOT life of the lubricating base oil of the invention is preferably 350 min or longer, more preferably 400 min or longer and even more preferably 440 min or longer. If the RBOT life of the lubricating base oil is less than the specified lower limit, the viscosity-temperature characteristic and heat and oxidation stability of the lubricating base oil will tend to be reduced, while the efficacy of additives when added to the lubricating base oil will also tend to be reduced.

The RBOT life for the purpose of the invention is the RBOT value as measured according to JIS K 2514-1996, for a composition obtained by adding a phenol-based antioxidant (2,6-di-tert-butyl-p-cresol: DBPC) at 0.6% by mass to the lubricating base oil.

The lubricating base oil of the invention having the composition described above exhibits an excellent viscosity-temperature characteristic and low-temperature viscosity characteristic, while also having low viscous resistance and stirring resistance and improved heat and oxidation stability and frictional properties, making it possible to achieve an increased friction reducing effect and thus improved energy savings. When additives are included in the lubricating base oil of the invention, the functions of the additives (improved low-temperature viscosity characteristic with pour point depressants, improved heat and oxidation stability by antioxidants, increased friction reducing effect by friction modifiers, improved wear resistance by anti-wear agents, etc.) are exhibited at a higher level. The lubricating base oil of the invention can therefore be applied as a base oil for a variety of lubricating oils. The specific use of the lubricating base oil of the invention may be as a lubricating oil for an internal combustion engine such as a passenger vehicle gasoline engine, two-wheel vehicle gasoline engine, diesel engine, gas engine, gas heat pump engine, marine engine, electric power engine or the like (internal combustion engine lubricating oil), as a lubricating oil for a drive transmission such as an automatic transmission, manual transmission, non-stage transmission, final reduction gear or the like (drive transmission oil), as a hydraulic oil for a hydraulic power unit such as a damper, construction machine or the like, or as a compressor oil, turbine oil, industrial gear oil, refrigerator oil, rust preventing oil, heating medium oil, gas holder seal oil, bearing oil, paper machine oil, machine tool oil, sliding guide surface oil, electrical insulating oil, cutting oil, press oil, rolling oil, heat treatment oil or the like, and using the lubricating base oil of the invention for these purposes will allow the improved characteristics of the lubricating oil including the viscosity-temperature characteristic, heat and oxidation stability, energy savings and fuel efficiency to be exhibited at a high level, together with a longer lubricating oil life and lower levels of environmentally unfriendly substances.

The lubricating oil composition of the invention may be used alone as a lubricating base oil according to the invention, or the lubricating base oil of the invention may be combined with one or more other base oils. When the lubricating base oil of the invention is combined with another base oil, the proportion of the lubricating base oil of the invention in the total mixed base oil is preferably at least 30% by mass, more preferably at least 50% by mass and even more preferably at least 70% by mass.

Other base oils used in combination with the lubricating base oil of the invention are not particularly restricted, and examples of mineral base oils include solvent refined mineral oils, hydrocracked mineral oils, hydrorefined mineral oils and solvent dewaxed base oils that fail to satisfy some or all of the aforementioned conditions (i)-(iii).

As synthetic base oils there may be mentioned poly-α-olefins and their hydrogenated forms, isobutene oligomers and their hydrogenated fours, isoparaffins, alkylbenzenes, alkylnaphthalenes, diesters (ditridecyl glutarate, di-2-ethylhexyl adipate, diisodecyl adipate, ditridecyl adipate, di-2-ethylhexyl sebacate and the like), polyol esters (trimethylolpropane caprylate, trimethylolpropane pelargonate, pentaerythritol 2-ethylhexanoate, pentaerythritol pelargonate and the like), polyoxyalkylene glycols, dialkyldiphenyl ethers and polyphenyl ethers, among which poly-α-olefins are preferred. Typical poly-α-olefins include C2-32 and preferably C6-16 α-olefin oligomers or co-oligomers (1-octene oligomer, decene oligomer, ethylene-propylene co-oligomers and the like), and their hydrides.

There are no particular restrictions on the process for producing poly-α-olefins, and as an example there may be mentioned a process wherein an α-olefin is polymerized in the presence of a polymerization catalyst such as a Friedel-Crafts catalyst comprising a complex of aluminum trichloride or boron trifluoride with water, an alcohol (ethanol, propanol, butanol or the like) and a carboxylic acid or ester.

The lubricating oil composition of the invention may also contain additives if necessary. Such additives are not particularly restricted, and any additives that are commonly employed in the field of lubricating oils may be used. Specific lubricating oil additives include antioxidants, ashless dispersants, metal cleaning agents, extreme-pressure agents, antiwear agents, viscosity index improvers, pour point depressants, friction modifiers, oiliness agents, corrosion inhibitors, rust-preventive agents, demulsifiers, metal deactivating agents, seal swelling agents, antifoaming agents, coloring agents, and the like. These additives may be used alone or in combinations of two or more. Particularly, when the lubricating oil composition of the invention comprises a pour point depressant, the effect of adding the pour point depressant in the lubricating base oil of the invention is maximally exhibited, thus allowing an excellent low-temperature viscosity characteristic to be obtained. In this case, the content of the pour point depressant is 0.05-2% by mass and preferably 0.1-1.5% by mass based on the total amount of the composition. The weight-average molecular weight of the pour point depressant is preferably 10,000-300,000 and more preferably 50,000-200,000, and the pour point depressant is most preferably a polymethacrylate-based compound.

EXAMPLES

The present invention will now be explained in greater detail based on examples and comparative examples, with the understanding that these examples are in no way limitative on the invention.

Example 1

For Example 1, first a fraction separated by vacuum distillation in a process for refining of a solvent refined base oil was subjected to solvent extraction with furfural and then hydrotreatment, and this was followed by solvent dewaxing with a methyl ethyl ketone-toluene mixed solvent. The wax portion removed during solvent dewaxing and obtained as slack wax (hereunder, "WAX1") was used as the feed stock oil for the lubricating base oil. The properties of WAX1 are shown in Table 1.

TABLE 1

| Name of crude wax | WAX1 |
|---|---|
| Kinematic viscosity at 100° C., $mm^2/s$ | 6.3 |
| Melting point, ° C. | 53 |
| Oil content, % by mass | 19.9 |
| Sulfur content, ppm by mass | 1900 |

WAX1 was then used as the feed stock oil for hydrotreament with a hydrotreatment catalyst. The reaction temperature and liquid space velocity were modified for a feed stock oil cracking severity of at least 5% by mass and a sulfur content of not greater than 10 ppm by mass in the oil to be treated. Here, a "feed stock oil cracking severity of at least 5% by mass" means that the proportion of the fraction lighter than the initial boiling point of the feed stock oil in the oil to be treated is at least 5% by mass with respect to the total feed stock oil amount, and this is confirmed by gas chromatography distillation.

Next, the treated product obtained from the hydrotreatment was subjected to hydrodewaxing in a temperature range of 315° C.-325° C. using a zeolite-based hydrodewaxing catalyst adjusted to a precious metal content of 0.1-5% by mass.

The treated product (raffinate) obtained by this hydrodewaxing was subsequently treated by hydrorefining using a hydrorefining catalyst. Next, the light and heavy portions were separated by distillation to obtain a lubricating base oil having the composition and properties shown in Table 4. In Table 4, the row headed "Proportion of normal paraffin-derived components in urea adduct" contains the values obtained by gas chromatography of the urea adduct obtained during measurement of the urea adduct value (same hereunder).

Comparative Example 1

A lubricating base oil having the composition and properties listed in Table 5 was produced in the same manner as Example 1, except that the hydrotreatment was performed to a hydrotreatment cracking severity of less than 5% for the starting WAX in Example 1, and the hydrodewaxing temperature was changed to 300° C. or higher and below 315° C.

Example 2

For Example 2, the wax portion obtained by further deoiling of WAX1 (hereunder, "WAX2") was used as the feed stock oil for the lubricating base oil. The properties of WAX2 are shown in Table 2.

TABLE 2

| Name of crude wax | WAX2 |
|---|---|
| Kinematic viscosity at 100° C., $mm^2/s$ | 6.8 |
| Melting point, ° C. | 58 |
| Oil content, % by mass | 6.3 |
| Sulfur content, ppm by mass | 900 |

Hydrotreatment, hydrodewaxing, hydrorefining and distillation were carried out in the same manner as in Example 1, except for using WAX2 instead of WAX1, to obtain a lubricating base oil having the composition and properties listed in Table 4.

Comparative Example 2

A lubricating base oil having the composition and properties listed in Table 5 was produced in the same manner as Example 2, except that the hydrodewaxing temperature in Example 2 was changed to 300° C. or higher and below 315° C.

Example 3

For Example 3 there was used an FT wax with a paraffin content of 95% by mass and a carbon number distribution of 20-80 (hereunder, "WAX3"). The properties of WAX3 are shown in Table 3.

TABLE 3

| Name of crude wax | WAX3 |
|---|---|
| 100° C. dynamic viscosity, $mm^2/s$ | 5.8 |
| Melting point, ° C. | 70 |
| Oil content, wt % | <1 |
| Sulfur content, ppm by wt. | <0.2 |

Hydrotreatment, hydrodewaxing, hydrorefining and distillation were carried out in the same manner as in Example 1, except for using WAX3 instead of WAX1, to obtain a lubricating base oil having the composition and properties listed in Table 4.

Comparative Example 3

A lubricating base oil having the composition and properties listed in Table 5 was produced in the same manner as Example 3, except that the hydrodewaxing temperature in Example 3 was changed to a temperature above 325° C.

In Tables 4 and 5, the row headed "Base oil viscous resistance (frictional coefficient)" shows the frictional coefficients measured at room temperature with a slip factor of 50% and a contact pressure of 0.5 GPa. The tester used was a Mini Traction Machine by PCS Instruments.

TABLE 4

| Example | | Example 1 | Example 2 | Example 3 |
|---|---|---|---|---|
| Feed stock oil | | WAX1 | WAX2 | WAX3 |
| Urea adduct value, % by mass | | 3.73 | 1.17 | 1.22 |
| Proportion of normal paraffin-derived components in urea adduct, % by mass | | 2.8 | 2.4 | 2.1 |
| Base oil composition (based on total base oil) | Saturated components, % by mass | 99.3 | 99.5 | 99.8 |
| | Aromatic components, % by mass | 0.5 | 0.3 | 0.1 |
| | Polar compound components, % by mass | 0.2 | 0.2 | 0.1 |
| Base oil composition (based on total saturated components) | Paraffin components, % by mass | 60.8 | 50.0 | 42.7 |
| | Monocyclic cycloparaffins, % by mass | 30.1 | 39.5 | 44.5 |
| | ≥Bicyclic cycloparaffins, % by mass | 9.1 | 10.5 | 12.8 |
| Sulfur content, ppm by mass | | <1 | <1 | <10 |
| Nitrogen content, ppm by mass | | <3 | <3 | <3 |
| Dynamic viscosity (40° C.), $mm^2/s$ | | 15.82 | 15.79 | 15.92 |
| Dynamic viscosity (100° C.), $mm^2/s$ | | 3.81 | 3.86 | 3.902 |
| Viscosity index | | 140 | 143 | 142 |
| Density (15° C.), $g/cm^3$ | | 0.8192 | 0.8197 | 0.8177 |
| Pour point, ° C. | | −27.5 | −22.5 | −22.5 |
| Freezing point, ° C. | | −26 | −24 | −24 |
| Iodine value | | 0.04 | 0.07 | 0.05 |
| Aniline point, ° C. | | 118.2 | 117.5 | 118.0 |
| NOACK evaporation, 250° C., mass % | | 13.1 | 13.8 | 14.1 |
| Distillation properties, ° C. | IBP, ° C. | 365 | 362 | 363 |
| | T10, ° C. | 398 | 401 | 404 |
| | T50, ° C. | 436 | 438 | 441 |
| | T90, ° C. | 463 | 468 | 463 |
| | FBP, ° C. | 491 | 496 | 490 |
| CCS viscosity (−35° C.), mPa · s | | 780 | 670 | 610 |
| BF viscosity (−25° C.), mPa · s | | 1,600 | 1,450 | 1,300 |
| Base oil viscosity resistance (friction coefficient) | | 0.025 | 0.027 | 0.029 |

TABLE 5

| | | Comp. Ex. 1 | Comp. Ex. 2 | Comp. Ex. 3 |
|---|---|---|---|---|
| Feed stock-oil | | WAX1 | WAX2 | WAX3 |
| Urea adduct value, % by mass | | 4.85 | 1.55 | 1.33 |
| Proportion of normal paraffin-derived components in urea adduct, % by mass | | 2.2 | 2.4 | 2.9 |
| Base oil composition (based on total base oil) | Saturated components, % by mass | 99.2 | 99.5 | 99.6 |
| | Aromatic components, % by mass | 0.5 | 0.3 | 0.3 |
| | Polar compound components, % by mass | 0.3 | 0.2 | 0.1 |
| Base oil composition (based on total saturated components) | Paraffin components, % by mass | 55.4 | 72.7 | 37.3 |
| | Monocyclic cycloparaffins, % by mass | 34.5 | 20.8 | 47.9 |
| | ≥Bicyclic cycloparaffins, % by mass | 10.1 | 6.5 | 14.8 |
| Sulfur content, ppm by mass | | <1 | <1 | <10 |
| Nitrogen content, ppm by mass | | <3 | <3 | <3 |
| Dynamic viscosity (40° C.), $mm^2/s$ | | 15.78 | 16.02 | 15.95 |
| Dynamic viscosity (100° C.), $mm^2/s$ | | 3.79 | 3.91 | 3.850 |
| Viscosity index | | 144 | 142 | 128 |
| Density (15° C.), $g/cm^3$ | | 0.8190 | 0.8188 | 0.8180 |
| Pour point, ° C. | | −20 | −15 | −27.5 |
| Freezing point, ° C. | | −21 | −17 | −28 |
| Iodine value | | 0.03 | 0.02 | 0.05 |
| Aniline point, ° C. | | 119.2 | 120.3 | 118.0 |
| NOACK evaporation, 250° C., % by mass | | 16.5 | 12.8 | 17.2 |

TABLE 5-continued

| | | Comp. Ex. 1 | Comp. Ex. 2 | Comp. Ex. 3 |
|---|---|---|---|---|
| Distillation properties, ° C. | IBP, ° C. | 368 | 370 | 352 |
| | T10, ° C. | 399 | 402 | 397 |
| | T50, ° C. | 438 | 440 | 436 |
| | T90, ° C. | 469 | 470 | 465 |
| | FBP, ° C. | 499 | 498 | 502 |
| CCS viscosity (−35° C.), mPa · s | | 4,200 | 3,900 | 3,010 |
| BF viscosity (−25° C.), mPa · s | | 6,300 | 5,900 | 7,100 |
| Base oil viscosity resistance (friction coefficient) | | 0.027 | 0.038 | 0.048 |

The invention claimed is:

1. A hydrocarbon-based lubricating base oil having a urea adduct value of not greater than 4% by mass, a viscosity index of 100 or greater, and a cycloparaffin content of 30-60% by mass based on the total amount of the saturated components, as measured by field desorption/ionization mass spectrometry.

2. A method for producing a lubricating base oil comprising: hydrocracking/hydroisomerization of a feed stock oil containing normal paraffins so as to obtain a treated product having a urea adduct value of not greater than 4% by mass, a viscosity index of 100 or higher, and a cycloparaffin content of 30-60% by mass based on the total amount of the saturated components, as measured by field desorption/ionization mass spectrometry.

3. The method for producing the lubricating base oil according to claim 2, wherein the feed stock oil comprises at least 50% by mass slack wax obtained by solvent dewaxing of a prescribed lubricating base oil.

4. A lubricating oil composition comprising a lubricating base oil according to claim 1.

5. The lubricating base oil according to claim 1, having a kinematic viscosity at 100° C. of 3.6-4.1 $mm^2/s$.

* * * * *